US006758228B1

(12) United States Patent
You

(10) Patent No.: US 6,758,228 B1
(45) Date of Patent: Jul. 6, 2004

(54) TRI-FOLDED UMBRELLA

(76) Inventor: Ching-Chuan You, P.O. Box 1-79, Taipei (TW)

( * ) Notice: Subject to any disclaimer, the term of this patent is extended or adjusted under 35 U.S.C. 154(b) by 0 days.

(21) Appl. No.: 10/372,991

(22) Filed: Feb. 26, 2003

(51) Int. Cl.[7] ..... A45B 25/00
(52) U.S. Cl. ..... 135/29; 135/31; 135/25.31
(58) Field of Search ..... 135/31, 29, 32, 135/22, 151, 25.3, 25.1, 25.31

(56) References Cited

U.S. PATENT DOCUMENTS 5,372,155 A * 12/1994 You ..... 135/29
5,715,853 A * 2/1998 Lin ..... 135/29
5,746,235 A * 5/1998 Lin ..... 135/29
6,076,540 A * 6/2000 You ..... 135/22
6,102,058 A * 8/2000 You ..... 135/29
6,345,637 B1 * 2/2002 Ko ..... 135/22
6,668,845 B2 * 12/2003 Lin et al. ..... 135/29
D484,680 S * 1/2004 You ..... D3/10
2003/0029485 A1 * 2/2003 Johnson et al. ..... 135/29
2003/0098049 A1 * 5/2003 Huang ..... 135/29
2003/0159726 A1 * 8/2003 You ..... 135/29

* cited by examiner

*Primary Examiner*—Ramon O. Ramirez
*Assistant Examiner*—Amy J. Sterling

(57) ABSTRACT

A tri-folded umbrella is disclosed. An enhanced frame of the umbrella comprises pivotably coupled first, second, and third yoke-shaped pivot members formed of plastic, first, second, and third latches, first, second, third ribs, first and second links, and a stretcher. The invention enables an easy assembly and a more compact size after folding.

11 Claims, 7 Drawing Sheets

TRI-FOLDED UMBRELLA

BACKGROUND OF THE INVENTION

1. Field of the Invention

The present invention relates to umbrellas and more particularly to a tri-folded umbrella with improved characteristics such as enhanced frame, easy assembly, and more compactness.

2. Description of Related Art

Umbrella frame designs take many different forms. A conventional tri-folded umbrella is shown in FIG. 8. Such umbrella frame 70 has a number of disadvantages as observed by the present inventor. For example, a rivet is used in each of seven pivot joints 71 to 77. However, it is known that riveting is a tedious task. Also, uniform quality of riveting on the pivot joints 71 to 77 for each frame element is not easy to control. Typically, there are about total 42 to 56 pivot joints in an umbrella frame. Unfortunately, one defective pivot joint will soon make the whole umbrella unusable after a short period of time due to rust in the pivot joints. Further, stress tends to concentrate on the pivot joints. As a result, the frame is susceptible of break in folding or expanding the umbrella.

An FRP umbrella for solving the problem of rust in the pivot joint caused by riveting is proposed. However, the FRP umbrella still suffered from several disadvantages. For example, ribs of the FRP umbrella frame are shaped as cylindrical bar for providing a sufficient support to the frame. Also, a variety of plastic molded connecting elements and pivot elements are fitted at two ends and in intermediate section of the cylindrical rib, respectively. As such, each frame element is increased in size, resulting in a bulky FRP frame. This can cause difficulties in storage, packing, and delivery of the umbrella. Hence, a commercialized tri-folded FRP umbrella is still not available after such technique has been developed for more than 20 years. Thus, continuing improvements in the tri-folded FRP umbrella frame are constantly being sought.

SUMMARY OF THE INVENTION

It is an object of the present invention to provide a tri-folded umbrella having the advantage of smooth folding operation.

It is another object of the present invention to provide a tri-folded umbrella having the advantages of being lightweight, easy to pack, and delivery.

It is a further object of the present invention to provide an enhanced strength, durable tri-folded umbrella.

The above and other objects, features and advantages of the present invention will become apparent from the following detailed description taken with the accompanying drawings.

DETAILED DESCRIPTION OF THE PREFERRED EMBODIMENTS

Figure 1:
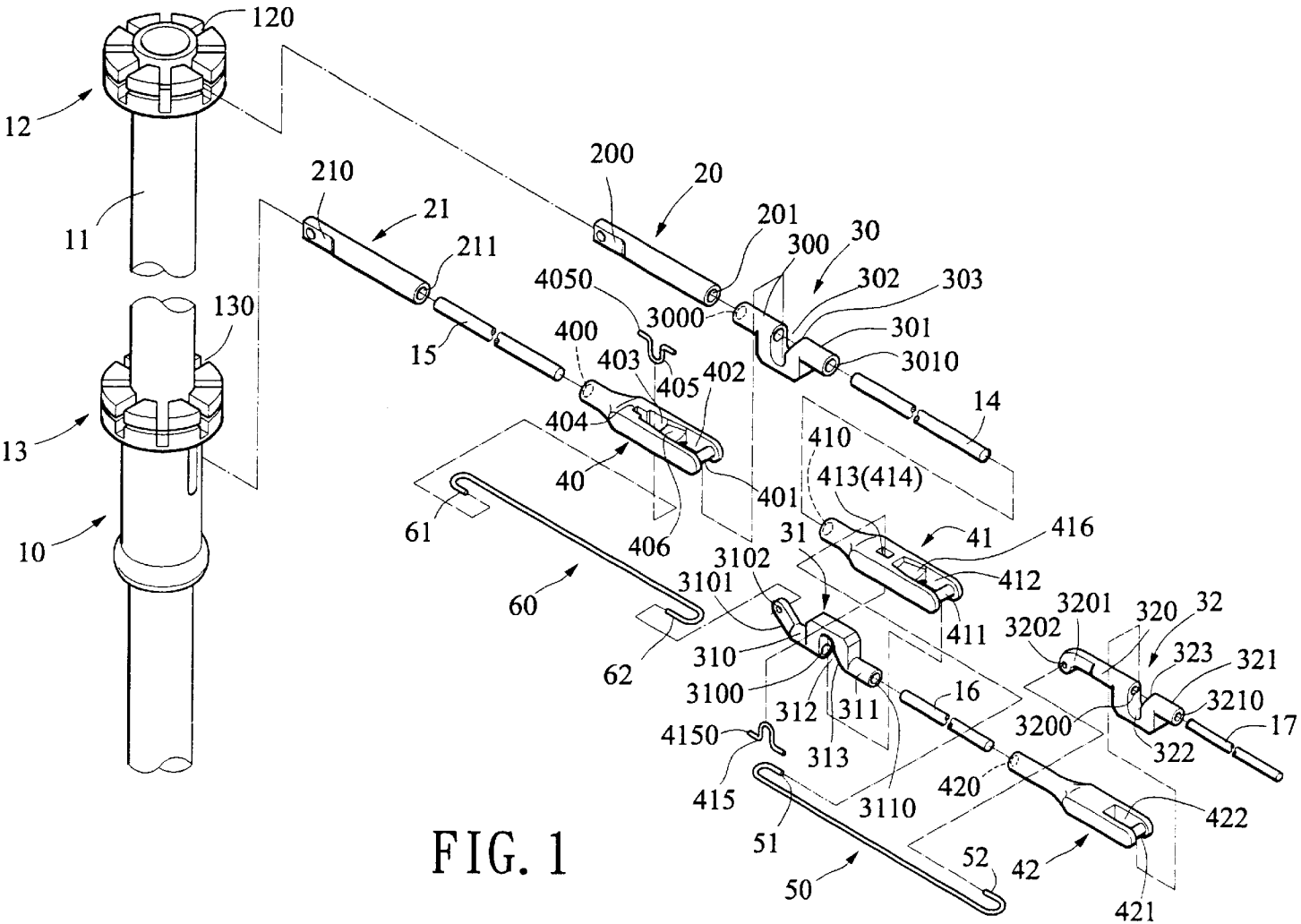
FIG. 1 is an exploded view depicting a partial frame of a tri-folded umbrella according to the invention.
Figure 2:
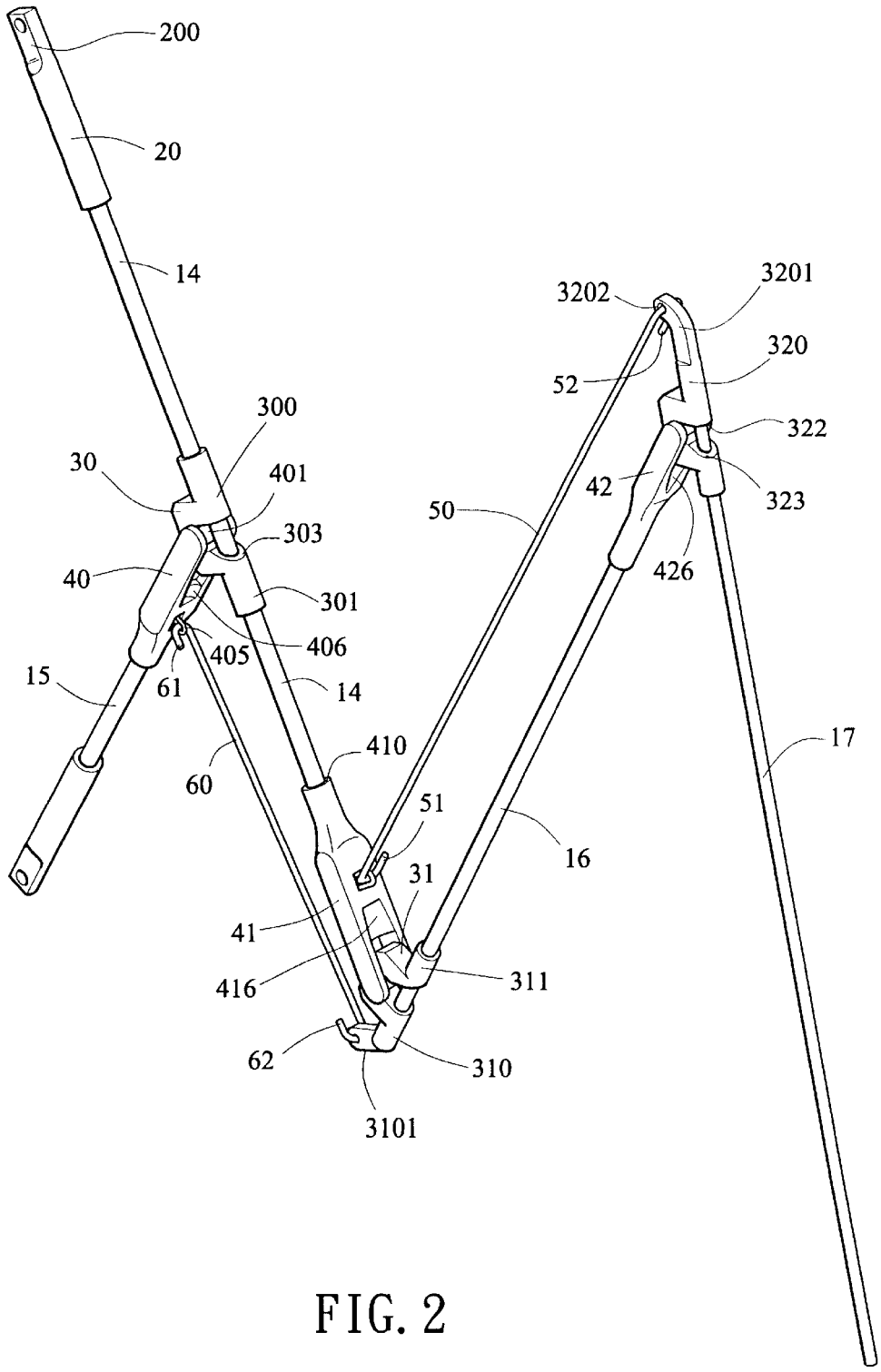
FIG. 2 is a perspective view depicting the assembled, partially folded frame shown in FIG. 1 with shank removed.
Figure 3:
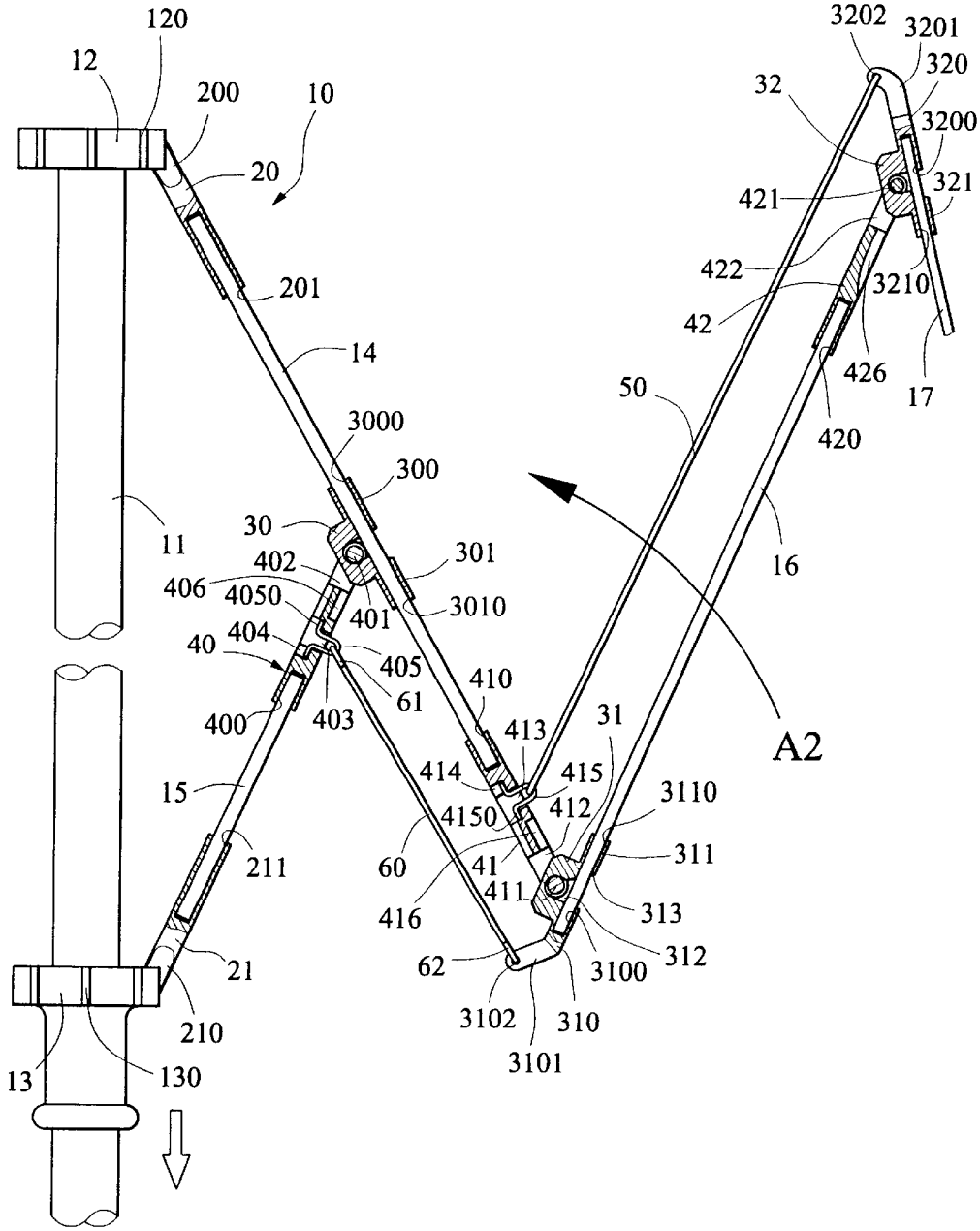
FIG. 3 is a cross-sectional view depicting the assembled, partially folded frame shown in FIG. 1.

Referring to FIGS. 1, 2, and 3, there is shown a tri-folded umbrella constructed in accordance with the invention in which an umbrella cloth is omitted for a brief of description. A frame 10 of the umbrella comprises a shank 11, an upper ring 12 having a plurality of slits 120 equally spaced around, a sliding lower ring 13 having a plurality of slits 130 equally spaced around, and a folding radial frame section comprising a plurality of units, equal to the number of the slits 120 or 130. Each unit comprises a plastic connection cylinder 20 having a flat extension 200 at one end pivotably coupled to the slit 120 and a bore 201 at the other end for receiving one end of a first rib 14 and a plastic connection cylinder 21 having a flat extension 210 at one end pivotably coupled to the slit 130 and a bore 211 at the other end for receiving one end of a stretcher 15.

A first latch 30 is put on the first rib 14 and comprises a U-shaped recess 302 in its center, a first projection 300 at one end, and a second projection 301 at the other end. A bore 3000 of the first projection 300 is communicated with a bore 3010 of the second projection 301 via the intermediate recess 302. The recess 302 has an oblique plane 303 extended toward the second projection 301. A plastic yoke-shaped first pivot member 40 is pivotably coupled to the other end of the stretcher 15 and comprises a bore 400 at one end, a pin 401 at the mouth of the other end, a first opening 402 defined by the pin 401, a second opening 403 adjacent the first opening 402, a recessed portion 404 on the mouth of the second opening 403, and a U-shaped element 405 having two horizontal shoulders 4050 rested on the recessed portion 404 and a central portion inserted into the second opening 403 and projected from the bottom surface of the first pivot member 40. The first latch 30 passes the opening 402 so that the recess 302 in contact with the pin 401.

A plastic yoke-shaped second pivot member 41 comprises a bore 410 at one end put on the other end of the first rib 14, a pin 411 at the mouth of the other end, a first opening 412 defined by the pin 411, a second opening 413 adjacent the first opening 412, a recessed portion 414 on the mouth of the second opening 413, and a U-shaped element 415 having two horizontal shoulders 4150 rested on the recessed portion 414 and a central portion inserted into the second opening 413 and projected from the top surface of the second pivot member 41.

A plastic second latch 31 passes the first opening 412 and comprises a recess 312 in contact with the pin 411, a cylindrical first projection 310 at one side having an arcuate flat extension 3101, a hole 3102 at an open end of the extension 3101, and a bore 3100, a cylindrical second projection 311 at the other side having a bore 3110, and an oblique plane 313 extended from the recess 312 toward the second projection 311. The bore 3110 is communicated with the bore 3100 via the intermediate recess 312.

A plastic yoke-shaped third pivot member 42 comprises a bore 420 at one end put on the other end of a second rib 16, a pin 421 at the mouth of the other end, and an opening 422 defined by the pin 421. A plastic third latch 32 is formed at one end of a third rib 17. The other end (not shown) of the third rib 17 is stitched to a periphery of an umbrella cloth as well known in the art. The third latch 32 passes the opening 422 and comprises a recess 322 in contact with the pin 421. Similar, to the second latch 31, the third latch 32 further comprises a cylindrical first projection 320 at one side having an arcuate flat extension 3201, a hole 3202 at an open end of the extension 3201, and a bore 3200, a cylindrical second projection 321 at the other side having a bore 3210, and an oblique plane 323 extended from the recess 322 toward the second projection 321. The bore 3200 is communicated with-the bore 3210 via the intermediate recess 322.

A first link 50 comprises a first hooked end 51 inserted into the U-shaped element 415 and a second hooked end 52 inserted into the hole 3202 so as to pivotably couple the third latch 32 and the second pivot member 41 together. Similarly, a second link 60 comprises a first hooked end 61 inserted into the U-shaped element 405 and a second hooked end 62 inserted into the hole 3102 so as to pivotably couple the second latch 31 and the first pivot member 40 together. Moreover, one end of the third rib 17 is inserted through the bores 3210 and 3200 for fastening. One end of the second rib 16 is inserted through the bores 3110 and 3100 for fastening. The first rib 14 is inserted through the bores 3000 and 3010 for fastening with one end of the first rib 14 fastened in the bore 201 and the other end thereof fastened in the bore 410. The stretcher 15 is fastened between the bores 211 and 400. As a result, the pair of the first latch 30 and the first pivot member 40, the pair of the second latch 31 and the second pivot member 41, the pair of the third latch 32 and the third pivot member 42 are pivotably coupled together respectively.

It is to be noted that the U-shaped elements 405 and 415 are one kind of pivotal joint members. They can be substituted by any other forms, such as pivotal ring or pivotal pin integrally formed with the second opening or recess, or integrally formed on one surface of the first and second pivot members 40, 41 to enable the first and second links 50, 60 to insert or hook thereto to attain the same purpose of the U-shaped element as mentioned above. It means that the U-shaped element 405, 415 is not only one form of the pivotal joint members.

Figure 4:
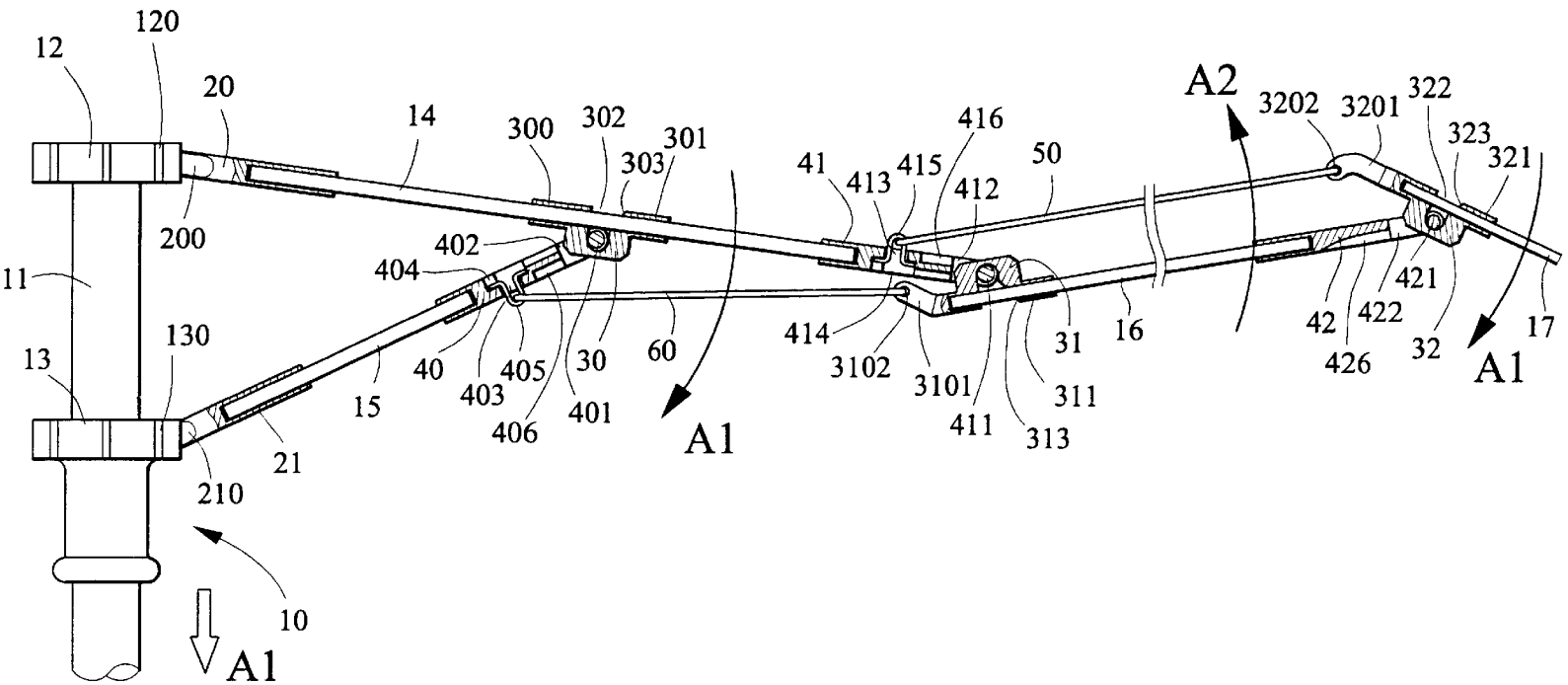
FIG. 4 is a view similar to FIG. 3 where the fully extended frame is being folded.
Figure 5:
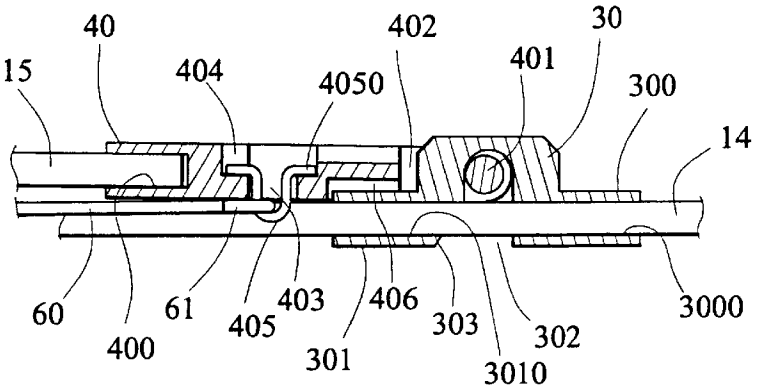
FIG. 5 is a cross-sectional view depicting folded first latch and first pivot member according to the invention.
Figure 6:
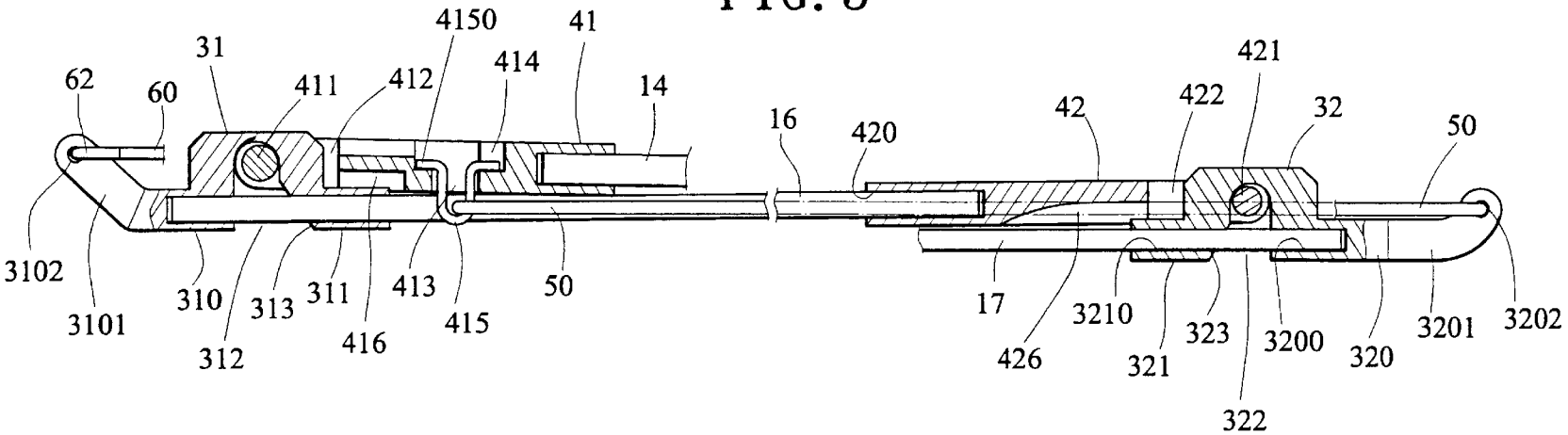
FIG. 6 is a cross-sectional view depicting folded second latch, third latch, second pivot member, and third pivot member according to the invention.
Figure 7:
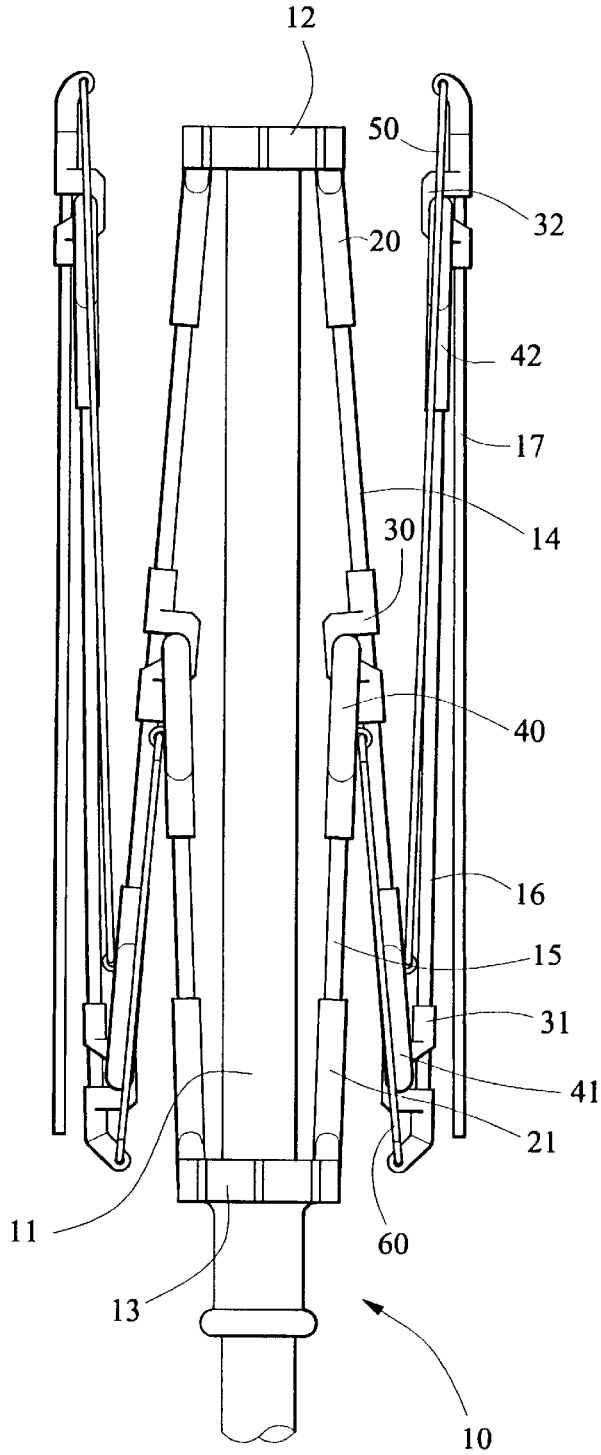
FIG. 7 is a side view depicting the fully folded frame according to the invention.
Figure 8:
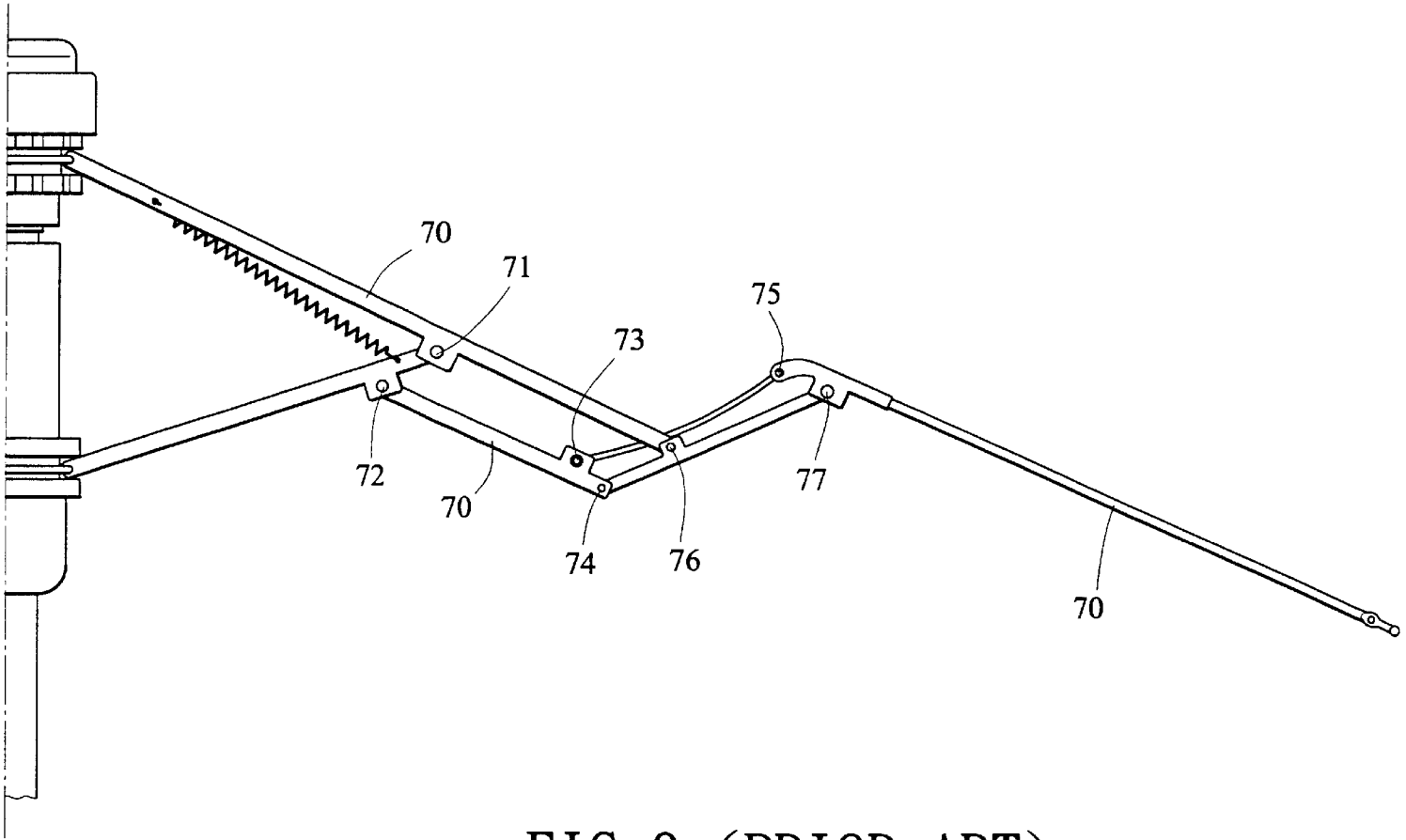
FIG. 8 (PRIOR ART)
FIG. 8 is a side view depicting a partial frame of a conventional tri-folded umbrella.

Referring to FIGS. 4 to 7 in conjunction with FIG. 3, a fold operation of the invention will now be described in detail below. The fully extended frame 10 begins to fold when a user slides down the lower ring 13. In response as shown in FIG. 4, the third rib 17 pivots clockwise as indicated by a right arrow A1, the second rib 16 and the first link 50 pivot counterclockwise as indicated by a central arrow A2, and the first rib 14 and the second link 60 pivot clockwise as indicated by a left arrow Al respectively. Finally, a fully tri-folded umbrella frame 10 is formed as shown in FIG. 7.

Note that the provisions of the arcuate flat extensions 3101 and 3201 at the second latch 31 and the third latch 32 can reduce size of the folded frame 10. Inclined recesses 406, 416, and 426 (see FIGS. 3–6) formed on one side of the first pivot member 40, the second pivot member 41, and third pivot member 42 corresponding to the second projections 301, 311, 321 of the first latch 30, the second latch 31, and the third latch 32 respectively will facilitate the folding and further reduce size of the folded frame.

While the invention herein disclosed has been described by means of specific embodiments, numerous modifications and variations could be made thereto by those skilled in the art without departing from the scope and spirit of the invention set forth in the claims.

What is claimed is:

1. A tri-folded umbrella comprising an umbrella cloth, a shank and a frame;

the shank including an upper ring having a plurality of slits equally spaced around and a sliding lower ring having a plurality of slits equally spaced around;

the frame comprising a plurality of units, equal to the number of the slits of either ring, each unit comprising:

a first latch comprising a recess, a first tube at one end, and a second tube at the other end aligned with the first tube;

second and third latches each comprising a recess, a hollow cylinder at one end having an extension, a hole at an open end of the extension, and a tube at the other end;

a first pivot member comprising a bore at one end, a first pin at a mouth of the other end, a first opening defined by the first pin wherein the first pin is rested on the recess of the first latch, a second opening adjacent the first opening, and a pivot joint member provided on the second opening;

a second pivot member comprising a bore at one end, a first pin at a mouth of the other end, a first opening defined by the first pin wherein the first pin is rested on the recess of the second latch, a second opening adjacent the first opening, and a pivot joint member provided on the second opening;

a third pivot member comprising a bore at one end, a second pin at a mouth of the other end, and a third opening defined by the second pin wherein the second pin is rested on the recess of the third latch;

a stretcher having one end pivotably coupled to the slit of the lower ring and the other end fastened in the bore of the first pivot member;

a first rib inserted through the tubes of the first latch so as to pivotably couple the first latch and the first pivot member together, the first rib having one coupled to the slit of the upper ring and the other end fastened in the bore of the second pivot member;

a second rib having one end inserted through the tube and into the hollow cylinder of the second latch for fastening so as to pivotably couple the second latch and the second pivot member together and the other inserted into the bore of the third pivot member for fastening;

a third rib having one end inserted through the tube and into the hollow cylinder of the third latch for fastening so as to pivotably couple the third latch and the third pivot member together and the other end of the third rib stitched to a periphery of the umbrella cloth;

a first link comprising a first hooked end inserted into the pivot joint member of the second pivot member and a second hooked end inserted into the hole of the third latch so as to pivotably couple the third latch and the second pivot member together; and a second link comprising a first hooked end inserted into the pivot joint member of the first pivot member and a second hooked end inserted into the hole of the second latch so as to pivotably couple the second latch and the first pivot member together.

2. The umbrella of claim 1, wherein one end of the first rib comprises a plastic connection cylinder having a flat extension pivotably coupled to the slit of the upper ring and one end of the stretcher comprises a plastic connection cylinder having a flat extension pivotably coupled to the slit of the lower ring.

3. The umbrella of claim 1, wherein each of the recesses of the first, the second and the third latch comprises an oblique plane at one side.

4. The umbrella of claim 1, wherein each of the first, the second, and third pivot members comprises an inclined recess disposed corresponding to a second projection of each of the first, the second, and the third latches, respectively.

5. The umbrella of claim 1, wherein each of the second and third latches comprises an arcuate flat extension at one side of the first projection thereof.

6. The umbrella of claim 1, wherein in the first and second pivot members, on a mouth of the second opening further comprises a recessed portion.

7. The umbrella of claim 6, wherein the pivot joint member is an U-shaped element having two horizontal shoulders rested on the recessed portion of the second opening and a central portion inserted into the second opening and projected from a surface thereof.

8. The umbrella of claim 1, wherein the pivot joint member is a pivotal ring integrally formed with the second opening of the first and second pivot member.

9. The umbrella of claim 1, wherein the pivot joint member is a pivotal pin integrally formed with the second opening of the first and second pivot members.

10. The umbrella of claim 1, wherein each of the rib and the stretcher is formed of fiberglass reinforced plastics.

11. The umbrella of claim 1, wherein each of the first, the second, and third pivot members and latches is formed of plastics.

* * * * *